US006550582B2

(12) United States Patent
Addy et al.

(10) Patent No.: US 6,550,582 B2
(45) Date of Patent: Apr. 22, 2003

(54) METHOD AND APPARATUS FOR PROCESSING A LARGE NUMBER OF ITEMS WITH A SELF-SERVICE CHECKOUT TERMINAL

(75) Inventors: John C. Addy, Lawrenceville, GA (US); Dusty L. Lutz, Dacula, GA (US)

(73) Assignee: NCR Corporation, Dayton, OH (US)

( * ) Notice: Subject to any disclaimer, the term of this patent is extended or adjusted under 35 U.S.C. 154(b) by 170 days.

(21) Appl. No.: 09/748,325

(22) Filed: Dec. 26, 2000

(65) Prior Publication Data

US 2002/0079168 A1 Jun. 27, 2002

(51) Int. Cl.[7] ..... A63F 9/02

(52) U.S. Cl. ..... 186/61; 186/59; 235/383; 177/52; 198/959

(58) Field of Search ..... 186/61, 59, 68, 186/69; 198/340, 341.01, 959; 235/383; 177/52, 60, 63; 209/1, 2

(56) References Cited

U.S. PATENT DOCUMENTS

| | | | | | |
|---|---|---|---|---|---|
| 4,779,706 | A | * | 10/1988 | Mergenthaler | 177/25.15 |
| 5,177,345 | A | * | 1/1993 | Baitz | 186/61 |
| 5,375,680 | A | * | 12/1994 | Ikeda et al. | 186/61 |
| 5,497,853 | A | * | 3/1996 | Collins et al. | 186/61 |
| 5,543,607 | A | * | 8/1996 | Watanabe et al. | 186/61 |
| 6,213,395 | B1 | * | 4/2001 | Dejaeger et al. | 186/61 |

FOREIGN PATENT DOCUMENTS

| | | | | |
|---|---|---|---|---|
| EP | 315159 A1 | * | 5/1989 | A47F/9/04 |
| JP | 1-11975 A | * | 5/1989 | G01G/11/00 |
| JP | 3-80384 A | * | 4/1991 | G06K/7/10 |

* cited by examiner

*Primary Examiner*—Donald P. Walsh
*Assistant Examiner*—Mark J. Beauchaine
(74) *Attorney, Agent, or Firm*—Maginot, Moore & Bowman LLP

(57) ABSTRACT

A self-service checkout terminal includes a terminal base having (i) a user side on which a user is positioned during operation of the self-service checkout terminal, (ii) a rear side which is opposite the user side, (iii) an upstream end portion, and (iv) a downstream end portion which is opposite the upstream end portion. The self-service checkout terminal includes a scanner for scanning a product code associated with an item for purchase. The scanner is secured to the upstream end portion of the terminal base. The self-service checkout terminal also includes a printer secured to the user side of the terminal base. The self-service checkout terminal further includes an item collection surface for supporting the item for purchase subsequent to scanning thereof. The item collection surface being secured to the downstream end portion of the terminal base. Moreover, the self-service checkout terminal includes a belt assembly for transporting the item for purchase in a direction toward the item collection surface, wherein the belt assembly is interposed between the user side of the terminal base and the rear side of the terminal base.

26 Claims, 2 Drawing Sheets

METHOD AND APPARATUS FOR PROCESSING A LARGE NUMBER OF ITEMS WITH A SELF-SERVICE CHECKOUT TERMINAL

TECHNICAL FIELD OF THE INVENTION

The present invention relates generally to a self-service checkout terminal, and more particularly to a method and apparatus for processing a large number of items with a self-service checkout terminal.

BACKGROUND OF THE INVENTION

In the retail industry, the largest expenditures are typically the cost of the goods sold followed closely by the cost of labor expended. With particular regard to the retail grocery or supermarket industry, the impetus to reduce labor costs has focused on reducing or eliminating the amount of time required to handle and/or process the items or goods to be purchased by a customer. To this end, there have been a number of self-service checkout terminal concepts developed which attempt to substantially eliminate the need for a checkout clerk.

A self-service checkout terminal is a system which is operated by a customer without the aid of a checkout clerk. What is meant herein by the term "customer" is a person who enters the retailer's store, selects his or her items for purchase from the shopping area of the store, checks out his or her items for purchase by use of a self-service checkout terminal, tenders payment for his or her items for purchase, and then exits the store subsequent to tendering payment. Hence, as used herein, a customer is distinguished from a checkout clerk or other employee of the retailer in that a customer enters the retailer's store for the sole purpose of purchasing items from the store.

Hence, it should be appreciated that in regard to operation of a self-service checkout terminal, the customer scans individual items for purchase across a scanner and then places the scanned items into a grocery bag, if desired. The customer then pays for his or her purchases either at the self-service checkout terminal if so equipped, or at a central payment area which is staffed by a store employee. Thus, a self-service checkout terminal permits a customer to select, itemize, and in some cases pay for his or her purchases without the assistance of the retailer's personnel.

Heretofore designed self-checkout terminals have been designed for use as "centralized" terminals (i.e. scanning, bagging and tendering conducted at traditional store "front-end"). Moreover, such terminal designs have focused primarily on "express" orders (e.g. a transaction that has, for example, fifteen or less items per transaction). Due to, for example, user (e.g. customer) arm-reach limitations and/or security issues, heretofore designed self-service checkout terminals have been configured to utilize only two or three grocery bags at a time. As such, the order size (i.e. the number of items in a given transaction) has been limited to the number of items that the customer can place into the two or three grocery bags.

In response to this drawback, a number of alternative terminal configurations have been designed. In one such configuration, the customer does not place his or her items directly into grocery bags, but rather the customer places the items onto a moving belt that takes the items to a bagging area. As such, the customer is able to itemize (i.e. scan) larger item orders. However, due to space constraints and, again, customer arm-reach issues, the customer may not complete his or her transaction by tendering payment (e.g. credit/debit card or cash payment) at such a terminal. Instead, the customer is forced to go to a separate operator paystation to complete the transaction. Such an operator paystation is typically operated by retail personnel.

Such a system has a number of drawbacks associated therewith. Firstly, operational efficiency of the system is reduced since the customer is required to perform the step of travelling to a separate location within the store to tender payment for his or her items for purchase. Secondly, since the retailer must utilize an employee to operate the paystation, certain of the goals of a self-service checkout terminal are not realized (e.g. labor reduction) since the retailer must bear the labor cost of the operator.

What is needed therefore is a self-service checkout terminal which overcomes one or more of the above-mentioned drawbacks. What is particularly needed is a self-service checkout terminal which allows the customer to checkout a relatively large item order without intervention from retail personnel. What is further needed is a self-service checkout terminal which allows the customer to checkout relatively large item orders and tender payment for such a large item order without intervention from retail personnel.

SUMMARY OF THE INVENTION

In accordance with one embodiment of the present invention, there is provided a self-service checkout terminal. The self-service checkout terminal includes a terminal base having (i) a user side on which a user is positioned during operation of the self-service checkout terminal, (ii) a rear side which is opposite the user side, (iii) an upstream end portion, and (iv) a downstream end portion which is opposite the upstream end portion. The self-service checkout terminal includes a scanner for scanning a product code associated with an item for purchase. The scanner is secured to the upstream end portion of the terminal base. The self-service checkout terminal also includes a printer secured to the user side of the terminal base. The self-service checkout terminal further includes an item collection surface for supporting the item for purchase subsequent to scanning thereof. The item collection surface is secured to the downstream end portion of the terminal base. Moreover, the self-service checkout terminal includes a belt assembly for transporting the item for purchase in a direction toward the item collection surface, wherein the belt assembly is interposed between the user side of the terminal base and the rear side of the terminal base.

In accordance with another embodiment of the present invention, there is provided a self-service checkout terminal. The self-service checkout terminal includes a terminal base having (i) a user side on which a user is positioned during operation of the self-service checkout terminal, and (ii) a rear side which is opposite the user side. The self-service checkout terminal also includes a scanner for scanning a product code associated with an item for purchase. The scanner is configured to be operated by the user when the user is positioned on the user side of the terminal base. The self-service checkout terminal also includes a payment device for allowing the user to tender payment for the item for purchase. The payment device is configured to be operated by the user when the user is positioned on the user side of the terminal base. In addition, the self-service checkout terminal includes an item collection surface for supporting the item for purchase subsequent to scanning thereof. The item collection surface is secured to the terminal base. Moreover the self-service checkout terminal includes a belt assembly for transporting the item for purchase in a direction toward the item collection surface. The belt assembly is (i) interposed between the user side of the terminal base and the rear side of the terminal base, and (ii) interposed between the scanner and the item collection surface.

In accordance with yet another embodiment of the present invention, there is provided a self-service checkout terminal. The self-service checkout terminal includes a terminal base having (i) a user side on which a user is positioned during operation of the self-service checkout terminal, and (ii) a rear side which is opposite the user side. The self-service checkout terminal also includes a scanner for scanning a product code associated with an item for purchase. The scanner has a first scanning window which is disposed in a substantially horizontal orientation and a second scanning window which is disposed in a substantially vertical orientation. The second scanning window faces the user side of the terminal base. The self-service checkout terminal also includes a payment device for allowing the user to tender payment for the item for purchase. The payment device is positioned in contact with the terminal base so as to face the user side of the terminal base. Moreover, the self-service checkout terminal also includes an item collection surface for supporting the item for purchase subsequent to scanning thereof. The item collection surface is secured to the terminal base. Yet further, the self-service checkout terminal includes a belt assembly for transporting the item for purchase in a direction toward the item collection surface. The belt assembly is (i) interposed between the user side of the terminal base and the rear side of the terminal base, and (ii) interposed between the scanner and the item collection surface.

It is therefore an object of the present invention to provide a new and useful self-service checkout terminal.

It is moreover an object of the present invention to provide an improved self-service checkout terminal.

It is a further object of the present invention to provide a new and useful method of operating a self-service checkout terminal.

It is also an object of the present invention to provide an improved method of operating a self-service checkout terminal.

It is yet another object of the present invention to provide a self-service checkout terminal which allows the customer to checkout a relatively large item order without intervention from retail personnel.

It is also an object of the present invention to provide a self-service checkout terminal which allows the customer to checkout relatively large item orders and tender payment for such a large item order without intervention from retail personnel.

The above and other objects, features, and advantages of the present invention will become apparent from the following description and the attached drawings.

DETAILED DESCRIPTION OF THE INVENTION

Figure 1:
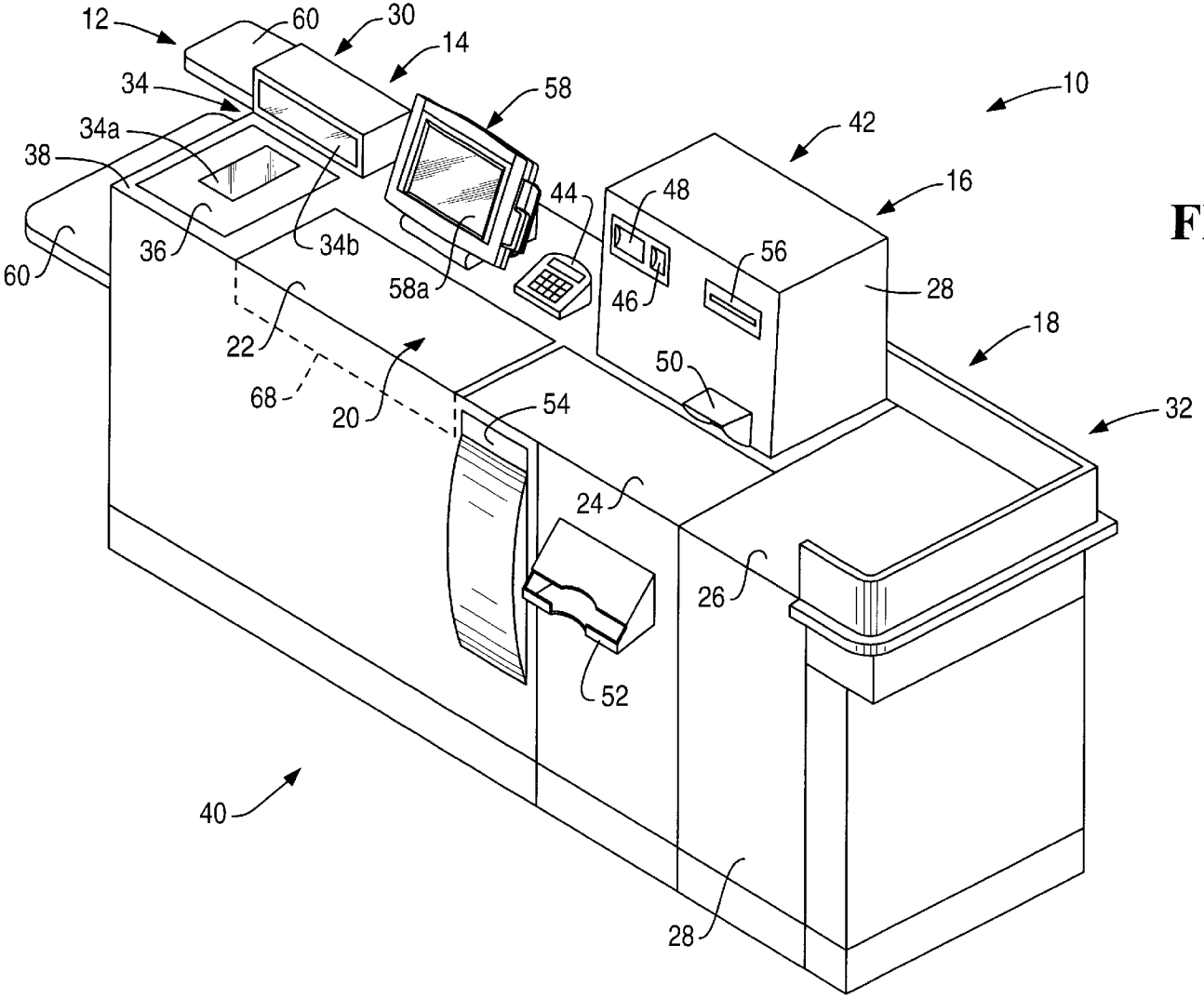
FIG. 1 is a perspective view of a self-service checkout terminal which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
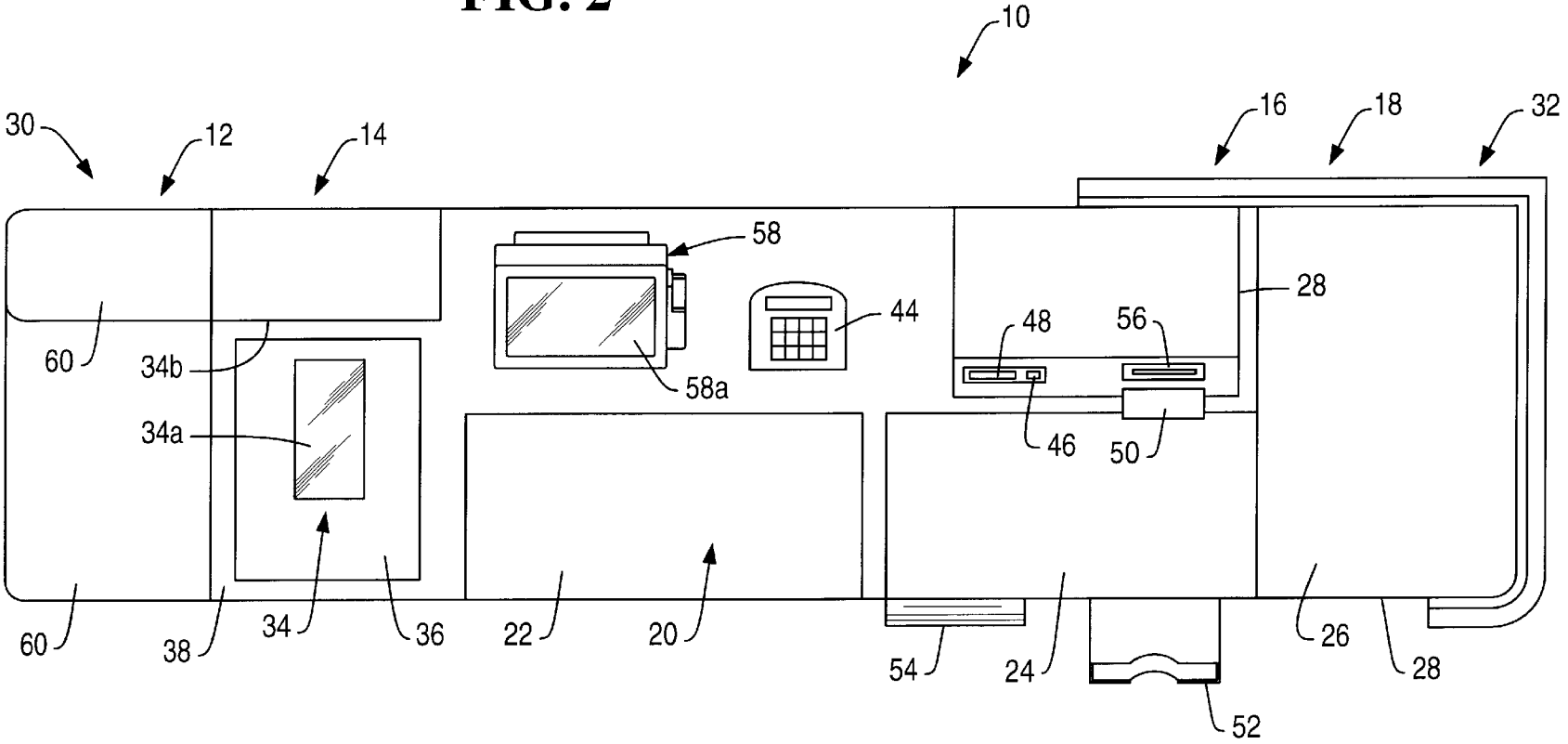
FIG. 2 is a plan view of the self-service checkout terminal of FIG. 1.

Referring now to FIGS. 1 and 2, there is shown a self-service checkout terminal 10 for use in a retail business such as a grocery store. The self-service checkout terminal 10 includes a pre-scan area 12, an itemization area 14, a payment area 16, and a post-scan area 18. The self-service checkout terminal 10 also includes an item transport mechanism such as belt assembly 20 which includes a security belt mechanism 22 and a takeaway belt mechanism 24. As will be discussed below in greater detail, the belt assembly 20 is utilized to convey items for purchase toward a item collection surface or area 26 of the post-scan area 18 subsequent to scanning of the items by a user of the self-service checkout terminal 10 (e.g. a customer).

The self-service checkout terminal 10 also includes a terminal base 28 for supporting the components associated therewith. The terminal base 28 may be embodied as a single cabinet-type structure or, alternatively, may be embodied as a number of separate structures secured to one another. The terminal base 28 has an upstream end portion 30 and a downstream end portion 32. The terms "upstream" and "downstream" are used herein to be consistent with the flow of items through the self-service checkout terminal 10 during a typical checkout procedure. In particular, an item enters at the area proximate the pre-scan area 12 then flows in a downstream direction to be scanned or otherwise entered at the itemization area 14. Once the item is scanned or otherwise entered at the itemization area 14, the item flows from the itemization area 14 in a downstream direction to the post-scan area 18 via the belt assembly 20.

The terminal 10 also includes a user side 40 and a rear side 42. More specifically, the terminal base 28 divides the self-service checkout terminal 10 into the user side 40 which is the side of the self-service checkout terminal 10 where the customer is positioned during a checkout transaction, and the rear side 42 which is the opposite side of the self-service checkout terminal 10. As will be discussed below in greater detail, each of the user-controlled or user-utilized components associated with the terminal 10 are positioned to face the user side 40 of the terminal base 28. As used herein, the terms "face", "faces", or "facing" when used in conjunction with a terminal component is intended to mean that an input and/or an output device associated with the component is oriented toward one side of the terminal so as to provide access to a user positioned on that side of the terminal (as opposed to the other side). For example, as described below, a vertical scanning window associated with the produce scanner "faces" the user side 40 since it is orientated to receive input from a user positioned on the user side 40 of the terminal base 28 when the user (who is positioned on the user side 40 of the terminal base 28) advances an item containing a machine-readable code in front of the scanning window. Note that, as configured, no user operation is performed from the rear side 42 of the terminal 10.

The pre-scan area 12 of the self-service checkout terminal 10 is located in the upstream end portion 30 of the terminal base 28. The pre-scan area 12 includes a number of shelves and cart-docking components 60 which may be utilized to support a shopping basket or the like (not shown) and/or dock with a shopping cart or the like (not shown). Such features facilitate the processing of relatively large item orders with the self-service checkout terminal 10.

The itemization area 14 of the self-service checkout terminal 10 is also located on the upstream end portion 30 of the terminal base 28 and includes a scanner 34 and a product scale 36. The scanner 34 conventionally scans or reads a product identification code such as a Universal Product Code (UPC), industrial symbol(s), alphanumeric character(s), or other indicia associated with an item to be purchased. One scanner which may be used in the present invention is a model number 5875 bi-optic scanner which is commercially available from NCR Corporation of Dayton, Ohio.

The scanner 34 includes a first scanning window 34*a* and a second scanning window 34*b*. The first scanning window 34*a* is disposed in a substantially horizontal manner, whereas the second scanning window 34*b* is disposed in a substantially vertical manner, as shown in FIG. 1. More specifically, the terminal base 28 has a substantially horizontal upper surface 38. As shown in FIG. 1, the horizontal scanning window 34*a* is disposed in a relatively flush-mount arrangement with the upper surface 38 of the terminal base 28. Moreover, the product scale 36 is integrated with the scanner 34. More specifically, the product scale 36 is disposed substantially parallel to the upper surface 38 of the terminal base 28 and hence the horizontal scanning window 34*a* thereby enveloping the horizontal scanning window 34*a*. If an item such as produce is placed upon the product scale 36 or the horizontal scanning window 34*a*, the product scale 36 may be used to determine the weight of the item.

The scanner 34 also includes a light source (not shown) such as a laser, a rotating mirror (not shown) driven by a motor (not shown), and a mirror array (not shown). In operation, a laser beam reflects off the rotating mirror and mirror array to produce a pattern of scanning light beams. As the product identification code on an item is passed over the scanner 34, the scanning light beams scatter off the code and are returned to the scanner 34 where they are collected and detected. The reflected light is then analyzed electronically in order to determine whether the reflected light contains a valid code pattern. If a valid code pattern is present, the product identification code may then be utilized to retrieve product information associated with the item (e.g. the price of the item and the weight of the item).

As described, both the scanner 34 and the product scale 36 are configured to be operated by the customer when the customer is positioned on the user side 40 of the self-service checkout terminal 10. In particular, both the scanner 34 and the product scale 36 face the user side 40 of the terminal 10 and are therefore orientated in a manner that renders them accessible by the customer when he or she is positioned on the user side 40 of the terminal 10.

The payment area 16 of the self-service checkout terminal 10 includes the system components necessary to allow a customer to perform finalization functions such as tendering payment for his or her items for purchase and printing of transaction receipts. In particular, the payment area 16 of the self-service checkout terminal 10 includes an electronic payment terminal 44 having a card reader and keypad, a pair of currency acceptors such as a coin acceptor 46 and a bill acceptor 50, a corresponding pair of currency dispensers such as a coin dispenser 48 and a bill dispenser 52, and a receipt printer 54. Moreover, the payment area 16 of the self-service checkout terminal 10 may also be configured to include a coupon acceptor 56. The coupon acceptor 56 allows a customer to tender coupons, vouchers, or the like during operation of the self-service checkout terminal 10.

As shown in FIG. 1, the system components associated with the payment area are also configured to be operated by the customer when the customer is positioned on the user side 40 of the self-service checkout terminal 10. In particular, the system components associated with the payment area 16 are positioned to face the user side 40 of the self-service checkout terminal 10 so as to be accessible to a customer during a checkout transaction. Indeed, each of the components associated with the payment area 16 are secured to, or otherwise accessible from, the user side 40 of the terminal base 28. Such a configuration allows the customer to operate the system components of the payment area 16 himself or herself in order to tender payment for his or her items for purchase at the terminal 10 thereby eliminating the need to provide remote payment stations thereby overcoming an expensive drawback of other terminal designs which required the use of such remote payment stations.

The system components associated with the payment area 16 of the self-service checkout terminal 10 are provided to allow the customer to tender payment for his or her items for purchase during performance of a checkout transaction. In particular, once the customer has entered all of his or her items for purchase into the checkout terminal 10 during a self-service checkout transaction, the components associated with the payment area 16 are utilized to complete the self-service checkout transaction by (1) allowing payment to be tendered by either insertion of currency into a currency acceptor (i.e. the coin acceptor 46 and/or the bill acceptor 50), charging a credit card or debit card account, or decreasing an electronic dollar value amount stored on a smart card via the electronic payment terminal 44, and (2) printing a transaction receipt with the receipt printer 54. In the case of when a customer inserts currency into the coin acceptor 46 and/or the bill acceptor 50, the self-service checkout terminal 10 may provide change via a currency dispenser (i.e. the coin dispenser 48 and/or the bill dispenser 52).

Moreover, it should also be appreciated that the location of the payment area 16 provides operational advantages to the self-service checkout terminal 10 of the present invention. In particular, as shown in FIGS. 1 and 2, since the components associated with the payment area 16 are interposed between the itemization area 14 and the post-scan area 18, a customer's operation of the terminal 10 is facilitated since the use of such components follows the typical item flow through the terminal 10. Specifically during operation of the terminal 10, the customer will first enter his or her items via use of the scanner 34 or other components associated with the itemization area 14 and then advance in a downstream direction toward the payment area 16 (and then eventually advance to the item collection area 26 to bag his or her items). In such a manner, the functions of the terminal 10 are arranged so as to follow a similar flow. Moreover, such a configuration allows for the operational functions of the terminal 10 to be separated so as to allow a number of different customers to simultaneously utilize the terminal 10. For example, as shall be discussed in greater detail below, a subsequent customer may begin to enter his or her items for purchase while the previous customer is still bagging his or her items in the item collection area 26. Similarly, the configuration of the payment area 16 of the terminal 10 (i.e. positioned downstream of the itemization area 14) allows for the terminal 10 to be operated in a manner in which a subsequent customer may begin to enter his or her items for purchase while the previous customer is still tendering payment for his or her items in the payment area 16. Such operation would not be possible if, for example, the payment devices associated with the payment area 16 were positioned upstream of the components associated with the itemization area 14 (e.g. the scanner 34 or the product scale 36).

As alluded to above, the post-scan belt assembly 20 includes a security belt mechanism 22 and a takeaway belt mechanism 24. The security belt mechanism 22 and the takeaway belt mechanism 24 are provided to transport items which have been scanned with the scanner 34 or otherwise entered into the self-service checkout terminal 10 to the item collection area or surface 26 where the items are placed into grocery bags or the like by the customer subsequent to tendering payment for his or her items. Such a configuration is advantageous in that a customer having a large item order (i.e. having a large number of items for purchase) may scan such items and then simply place them on the upper surface of the belt associated with the security belt mechanism 22 in order transport the items to the collection area 26. Once the customer has paid for his or her items, he or she may then remove the items from the collection area 26 by, for example, bagging the items into a number of grocery bags (not shown). In such a configuration, a number of order separating mechanisms (not shown) may be utilized to separate the scanned items belonging to one customer from those items belonging to a subsequent customer. In this manner, a subsequent customer may begin to enter his or her items for purchase while the previous customer completes his or her bagging operation thereby increasing the throughput efficiency associated with operation of the terminal.

The self-service checkout terminal 10 also includes a security scale 68. The security scale 68 is a weight scale which monitors the weight of items positioned on the belt associated with the security belt mechanism 68. Specifically, when an item is scanned with the scanner 34 and thereafter placed in the post-scan area 18, the detected weight of the item (as detected by the security scale 68) may be compared to a known weight value of the item that is stored in a database in order to confirm that a different, more expensive item was not substituted for the scanned item. It should be appreciated that the database may be in the form of a master database which includes every item sold by the retailer, or may be a"transaction level"database which is constructed locally at the self-service checkout terminal 10 during operation thereof.

It should be appreciated that a number of security schemes utilizing the security scale 68 may be employed during operation of the self-service checkout terminal 10. Examples of security schemes utilizing a security scale that is somewhat similar to the security scale 68 of the present invention are disclosed in U.S. Pat. No. 5,952,642 entitled "Method and Apparatus for Detecting Item Substitutions During Entry of an Item into a Self-Service Checkout Terminal" by Dusty Lutz, which was issued on Sep. 14, 1999, along with copending U.S. patent applications Ser. No. 08/990,241 entitled "Method and Apparatus for Detecting Item Placement and Item Removal During Operation of A Self-Service Checkout Terminal" which was filed on Dec. 15, 1997, by Jim Morrison and Dusty Lutz; and Ser. No. 09/071,024 entitled "Method of Monitoring Item Shuffling in a Post-Scan Area of a Self-Service Checkout Terminal" which was filed on May 1, 1998, by Dusty Lutz, Chris Malchak, Tim Mason, Ali Vassigh. The disclosures of the above-identified issued patent along with each of the above-identified patent applications are hereby incorporated by reference, and are assigned to the same assignee as the present invention.

In any event, if the security scale 68 detects any inconsistencies in the detected weight of one or more items (relative to their anticipated weight values), the direction of travel of the belt associated with the security belt mechanism 22 is reversed so as to prevent the item from continuing onward toward the collection area 26. Moreover, a number of error messages (audio, video, or any combination thereof may be generated to instruct the customer to correct the detected discrepancy.

The use of a separate belt mechanism (i.e. the takeaway belt mechanism 24) for transporting items across the remainder of their travel distance to the collection area 26 facilitates the above-described operation of the security scale 68. Specifically, during operation of the terminal 10, the customer's item order may include a large enough number items to cause items to "pile up" in the collection area 26 and as a result "back up" onto the top surface of the belt associated with the takeaway belt mechanism 24. Such back up onto the belt associated with the takeaway belt mechanism 24 is preferable over such back up onto the security belt 22. Specifically, if the belt assembly 20 were configured as a single belt mechanism, such back up of items onto such a single belt would cause the security scale 68 to erroneously detect the weight of the backed up items thereby activating a number of security alerts and the like. However by separating the belt assembly 20 into the separate belt mechanisms 22, 24 such "false alarms" are prevented since the security scale 68 does not monitor item weights on the belt associated with the takeaway belt 24.

The self-service checkout terminal 10 also includes an interactive customer interface terminal 58. The interactive customer interface terminal 58 includes a display monitor **58*a* which is provided to display retail information to the customer during operation of the self-service checkout terminal 10. For example, transaction information such as item price, item description, total amount of the transaction, instructions, etcetera is displayed to the customer on the display monitor 58*a* during operation of the self-service checkout terminal 10**.

The display monitor **58*a* is preferably a known touch screen monitor which can generate data signals when certain areas of the screen are touched by a customer. Hence, the display monitor 58*a* may be utilized by the customer to input information into the self-service checkout terminal 10. For example, the customer may manually enter retail information such as item codes and quantities into the self-service checkout terminal 10 by use of the touch screen associated with the display monitor 58*a*. The customer may indicate his or her preferred method of payment (e.g. cash, credit, or debit card) by touching the appropriate area of the touch screen associated with the display monitor 58*a*. A portion of the touch screen associated with the display monitor 58*a*** may also be utilized as a "help button" such that assistance is provided to the customer when it is touched by the customer.

Moreover, the interactive customer interface terminal 58 is preferably embodied as a stand-alone, kiosk-type device which is, in essence, a modified flat panel personal computer (PC) which includes a number of components commonly associated therewith. For example, the interactive customer interface terminal 58 includes a processing unit (not shown), along with other commonly utilized PC components such as an Ethernet controller, a number of video and audio control devices, a storage memory device such as a hard drive device, and a number of connector ports for coupling the interface terminal 58 to a number of retail peripheral devices such as the scanner 34, the product scale 36, the components associated with the payment area 16, and the security scale 68. Hence, in addition to displaying transaction information to the customer, the interactive customer interface terminal 58 functions as the main processing device or controller for controlling operation of the self-service checkout terminal 10. It should be appreciated that the interactive customer interface terminal 58 may be embodied as any stand-alone, kiosk-type device which includes the aforedescribed components (e.g. a display monitor, PC etcetera). One such stand-alone, kiosk-type device which is particularly useful as the interactive customer interface terminal of the present invention is an Informa model information terminal which is commercially available from NCR Corporation.

OPERATION OF THE PRESENT INVENTION

In operation, the self-service checkout terminal 10 of the present invention may be utilized by a customer to perform a self-service checkout transaction of varying item order sizes including relatively large order sizes. In particular, once the customer has selected all of his or her items for purchase from the shopping area of the retailer's store, the customer approaches the self-service checkout terminal 10. The customer then utilizes one of the components 60 in the pre-scan area 12 to dock or otherwise support his or her shopping basket (not shown) or shopping cart (not shown). The customer may then perform a number of initialization steps such as identifying himself or herself so that the details of the customer's transaction can be tracked for purposes associated with the retailer's customer loyalty program.

The customer then removes the individual items for purchase from his or her shopping basket or cart and thereafter individually enters the items into the self-service checkout terminal 10 by use of the scanner 34, the product scale 36, and/or the touch screen associated with the display monitor 58*a*. Specifically, the customer may enter an item by scanning the item with the scanner 34 in order to read the machine readable code thereon. Items which are sold by weight such as produce items may be entered by placing the item on the product scale 36 (or the scanning window 34*a*) and thereafter entering a code such as a product lookup code (PLU) associated with the item via the touch screen associated with the display monitor 58*a*. Moreover, if for some reason the machine readable code associated with the item cannot be read by the scanner 34, the customer may manually enter the item's product code by use of the touch screen associated with the display monitor 58*a*.

In any event, after the customer enters an item, he or she places the item onto the belt assembly 20. Specifically, the customer places the entered item onto the upper surface of the transport belt of the security belt mechanism 22. The security belt mechanism 22 then transports the item in a downstream direction toward the item collection area 26. During such movement of the item by the security belt mechanism 22, the security scale 68 is utilized to determine the weight of the item. As discussed above, the self-service checkout terminal 10 may utilize any one or more of numerous different security schemes in order to determine if the item being advanced by the security belt mechanism 22 has been properly entered into the terminal 10 (as opposed to an unscanned item or a relatively expensive item that was intentionally substituted for a less expensive item that was scanned by the customer). If the terminal 10 determines that an improper item is located on the belt associated with the security belt mechanism 22, the terminal 10 may execute a number of security measures such as reversing the direction of travel of the belt to move the item back toward the scanner, generating error messages to the customer, and/or notifying retail personnel. However, once all such discrepancies have been resolved (or if none actually existed), each of the customer's items will be transferred from the security belt mechanism 22 to the takeaway belt mechanism 24, and ultimately advanced to the item collection area 26.

Once all of the customer's items have been entered (and hence advanced to the item collection area 26 by the belt assembly 20), the customer may then tender payment for his or her items for purchase. In particular, once the customer has entered all of his or her items for purchase into the checkout terminal 10, the components associated with the payment area 16 are utilized to complete the self-service checkout transaction by allowing payment to be tendered by either insertion of currency into a currency acceptor (i.e. the coin acceptor 46 and/or the bill acceptor 50), or by use of the payment terminal 44 to charge a credit card or debit card account or decrease an electronic dollar value amount stored on a smart card. Thereafter, a transaction receipt is printed with the receipt printer 54 and output for presentation to the customer. In the case of when a customer inserts currency into the coin acceptor 46 and/or the bill acceptor 50, the checkout terminal 10 may provide change via a currency dispenser (i.e. the coin dispenser 48 and/or the bill dispenser 52).

Once the customer has tendered payment for his or her items for purchase, the customer may complete his or her transaction by placing his or her purchased items (which are located in the item collection area 26) into a number of grocery bags or the like. It should be appreciated that a subsequent customer may commence his or her transaction while the previous customer finishes the bagging of his or her items. In such a case, an order separating device may utilized to keep the two orders from becoming co-mingled.

As described herein, the self-service checkout terminal 10 of the present invention provides numerous advantages over heretofore designed self-service solutions. For example, by utilizing a belt assembly (i.e. the belt assembly 20) and an item collection area (i.e. the item collection surface 26), the self-service checkout terminal 10 of the present invention may be utilized to process relatively large item orders. Such capability to process large item orders is generally not practical (and in some cases even possible) with heretofore designed self-service solutions (e.g. "scan-and-bag" solutions).

Moreover, integration of the payment area 16 into the terminal 10 itself eliminates the need for a separate, remote payment station. In particular, use of the system components associated with the payment area 16 of the self-service checkout terminal 10 allows the customer to tender payment for his or her items without assistance from retail personnel thereby reducing labor costs associated with the retailer's operation.

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected.

There are a plurality of advantages of the present invention arising from the various features of the checkout system described herein. It will be noted that alternative embodiments of the checkout system of the present invention may not include all of the features described yet still benefit from at least some of the advantages of such features. Those of ordinary skill in the art may readily devise their own implementations of a checkout system that incorporate one or more of the features of the present invention and fall within the spirit and scope of the present invention as defined by the appended claims.

For example, although the security device has herein been described as being configured as a security scale (i.e. the security scale 68), and has significant advantages thereby in the present invention, it should be appreciated that certain of such advantages may be achieved by use of other types of security devices. For example, the self-service checkout terminal 10 may be equipped with a light curtain device or an optical/video device which monitors the identity of items being advanced by the securing belt mechanism 22.

What is claimed is:

1. A self-service checkout terminal, comprising:

a terminal base having (i) a user side on which a user is positioned during operation of said self-service checkout terminal, (ii) a rear side which is opposite said user side, (iii) an upstream end portion, and (iv) a downstream end portion which is opposite said upstream end portion;

a scanner for scanning a product code associated with an item for purchase, said scanner being secured to said upstream end portion of said terminal base;

a printer secured to said user side of said terminal base;

an item collection surface for supporting said item for purchase subsequent to scanning thereof, said item collection surface being secured to said downstream end portion of said terminal base; and a belt assembly for transporting said item for purchase in a direction toward said item collection surface, wherein said belt assembly is interposed between said user side of said terminal base and said rear side of said terminal base.

2. The self-service checkout terminal of claim 1, further comprising a currency dispenser secured to said user side of said terminal base.

3. The self-service checkout terminal of claim 2, wherein both said printer and said currency dispenser are interposed between said scanner and said item collection surface.

4. The self-service checkout terminal of claim 1, wherein said belt assembly includes a first belt mechanism and a second belt mechanism, said second belt mechanism being interposed between said first belt mechanism and said item collection surface.

5. The self-service checkout terminal of claim 4, further comprising a security scale, wherein said security scale is configured to measure weight of said item for purchase when said item for purchase is positioned on a transport belt associated with said first belt mechanism.

6. The self-service checkout terminal of claim 1, further comprising a display monitor secured to said terminal base so as to face said user side of said terminal base.

7. The self-service checkout terminal of claim 1, wherein:

said belt assembly includes a transport belt which is oriented in a substantially parallel relationship with both said user side and said rear side of said terminal base, and a longitudinal center line of said transport belt is positioned closer to said user side of said terminal base than to said rear side of said terminal base.

8. A self-service checkout terminal, comprising:

a terminal base having (i) a user side on which a user is positioned during operation of said self-service checkout terminal, and (ii) a rear side which is opposite said user side;

a scanner for scanning a product code associated with an item for purchase, said scanner being configured to be operated by said user when said user is positioned on said user side of said terminal base;

a payment device for allowing said user to tender payment for said item for purchase, said payment device being configured to be operated by said user when said user is positioned on said user side of said terminal base;

an item collection surface for supporting said item for purchase subsequent to scanning thereof, said item collection surface being secured to said terminal base; and a belt assembly for transporting said item for purchase in a direction toward said item collection surface, wherein said belt assembly is (i) interposed between said user side of said terminal base and said rear side of said terminal base, and (ii) interposed between said scanner and said item collection surface.

9. The self-service checkout terminal of claim 8, further comprising a printer for printing a transaction receipt, wherein said printer is configured to be operated by said user when said user is positioned on said user side of said terminal base.

10. The self-service checkout terminal of claim 9, further comprising a currency dispenser, wherein said currency dispenser is configured to be operated by said user when said user is positioned on said user side of said terminal base.

11. The self-service checkout terminal of claim 10, wherein both said printer and said currency dispenser are interposed between said scanner and said item collection surface.

12. The self-service checkout terminal of claim 8, wherein said belt assembly includes a first belt mechanism and a second belt mechanism, said second belt mechanism being interposed between said first belt mechanism and said item collection surface.

13. The self-service checkout terminal of claim 12, further comprising a security scale, wherein said security scale is configured to measure weight of said item for purchase when said item for purchase is positioned on a transport belt associated with said first belt mechanism.

14. The self-service checkout terminal of claim 8, further comprising a display monitor, wherein said display monitor is configured to display transaction information to said user when said user is positioned on said user side of said terminal base.

15. The self-service checkout terminal of claim 8, wherein:

said belt assembly includes a transport belt which is oriented in a substantially parallel relationship with both said user side of said terminal base and said rear side of said terminal base, and a longitudinal center line of said transport belt is positioned closer to said user side of said terminal base than to said rear side of said terminal base.

16. A self-service checkout terminal, comprising:

a terminal base having (i) a user side on which a user is positioned during operation of said self-service checkout terminal, and (ii) a rear side which is opposite said user side;

a scanner for scanning a product code associated with an item for purchase, said scanner having (i) a first scanning window which is disposed in a substantially horizontal orientation, and (ii) a second scanning window which is disposed in a substantially vertical orientation, said second scanning window facing said user side of said terminal base;

a payment device for allowing said user to tender payment for said item for purchase, said payment device being positioned in contact with said terminal base so as to face said user side of said terminal base;

an item collection surface for supporting said item for purchase subsequent to scanning thereof, said item collection surface being secured to said terminal base; and a belt assembly for transporting said item for purchase in a direction toward said item collection surface, wherein said belt assembly is (i) interposed between said user side of said terminal base and said rear side of said terminal base, and (ii) interposed between said scanner and said item collection surface.

17. The self-service checkout terminal of claim 16, further comprising a printer for printing a transaction receipt, wherein an output of said printer is configured to face said user side of said terminal base.

18. The self-service checkout terminal of claim 17, further comprising a currency dispenser, wherein an output of said currency dispenser is configured to face said user side of said terminal base.

19. The self-service checkout terminal of claim 18, wherein both said printer and said currency dispenser are interposed between said scanner and said item collection surface.

20. The self-service checkout terminal of claim 16, further comprising a security scale, wherein:

said belt assembly includes a first belt mechanism and a second belt mechanism, said second belt mechanism is interposed between said first belt mechanism and said item collection surface, and said security scale is configured to measure weight of said item for purchase when said item for purchase is positioned on a transport belt associated with said first belt mechanism.

21. A self-service checkout terminal, comprising:

a terminal base having (i) a user side on which a user is positioned during operation of said self-service checkout terminal, (ii) a rear side which is opposite said user side, (iii) an upstream end portion, and (iv) a downstream end portion which is opposite said upstream end portion;

a scanner for scanning a product code associated with an item for purchase, said scanner being secured to said upstream end portion of said terminal base;

an item collection surface for supporting said item for purchase subsequent to scanning thereof, said item collection surface being secured to said downstream end portion of said terminal base; and a belt assembly for transporting said item for purchase in a direction toward said item collection surface, wherein (i) said belt assembly includes a first belt mechanism and a second belt mechanism each positioned downstream of said scanner, and (ii) said belt assembly is interposed between said user side of said terminal base and said rear side of said terminal base.

22. The sew-service checkout terminal of claim 21, further comprising a security scale configured to measure night of said Item for purchase when said item for purchase is positioned on a first transport belt of said first belt mechanism.

23. The self-service checkout terminal of claim 22, wherein said first belt mechanism Is Interposed between said scanner and said second belt mechanism.

24. The self-service checkout terminal of claim 23, wherein a second transport belt of said second belt mechanism is juxtaposed to said first transport belt.

25. A self-service checkout terminal, comprising:

a terminal base having (i) a user side on which a user is positioned during operation of said self-service checkout terminal, (ii) a rear side which is opposite said user side, (iii) an upstream end portion, and (iv) a downstream end portion which is opposite said upstream end portion;

a scanner for scanning a product code associated with an item for purchase, said scanner being secured to said upstream end portion of said terminal base;

an item collection surface for supporting said item for purchase subsequent to scanning thereof, said item collection surface being secured to said downstream end portion of said terminal base;

a belt assembly for transporting said item for purchase in a direction toward said item collection surface, wherein said belt assembly is interposed between said user side of said terminal base and said rear side of said terminal base; and a security scale operable to measure weight of said item for purchase when said item for purchase is positioned on a transport belt associated with said belt assembly.

26. A self-service checkout terminal, comprising:

a terminal base having (i) a user side on which a user is positioned during operation of said self-service checkout terminal, and (ii) a rear side which is opposite said user side;

a scanner for scanning a product code associated with an item for purchase, said scanner being configured to be operated by said user when said user is positioned on said user side of said terminal base;

a payment device for allowing said user to tender payment for said item for purchase, said payment device being configured to be operated by said user when said user is positioned on said user side of said terminal base;

an item collection surface for supporting said item for purchase subsequent to scanning thereof, said item collection surface being secured to said terminal base; and a belt assembly for transporting said item for purchase in a direction toward said item collection surface, wherein said belt assembly is (i) interposed between said user side of said terminal base and said rear side of said terminal base, and (ii) interposed between said scanner and said item collection surface, wherein said belt assembly includes a first belt mechanism and a second belt mechanism, wherein said first belt mechanism is interposed between said scanner and said second belt mechanism.

* * * * *

UNITED STATES PATENT AND TRADEMARK OFFICE

CERTIFICATE OF CORRECTION

PATENT NO. : 6,550,582 B2 
DATED : April 22, 2003
INVENTOR(S) : Addy, J. and Lutz, D.

It is certified that error appears in the above-identified patent and that said Letters Patent is hereby corrected as shown below:

Column 13,
Line 51, delete “sew-service” and insert -- self-service --.
Line 52, delete “night” and insert -- weight --.

Signed and Sealed this

First Day of July, 2003

JAMES E. ROGAN
*Director of the United States Patent and Trademark Office*